US011306526B2

(12) United States Patent
Svara et al.

(10) Patent No.: US 11,306,526 B2
(45) Date of Patent: Apr. 19, 2022

(54) HINGES

(71) Applicant: TITUS D.O.O. DEKANI, Dekani (SI)

(72) Inventors: Valter Svara, Izola (SI); Franc Banko, Koper (SI); Carlo Migli, Lecco (IT)

(73) Assignee: TITUS D.O.O. DEKANI, Dekani (SI)

( * ) Notice: Subject to any disclaimer, the term of this patent is extended or adjusted under 35 U.S.C. 154(b) by 0 days.

(21) Appl. No.: 17/058,031

(22) PCT Filed: May 30, 2019

(86) PCT No.: PCT/EP2019/064147

§ 371 (c)(1),
(2) Date: Nov. 23, 2020

(87) PCT Pub. No.: WO2019/233884

PCT Pub. Date: Dec. 12, 2019

(65) Prior Publication Data

US 2021/0198931 A1 Jul. 1, 2021

(30) Foreign Application Priority Data

Jun. 5, 2018 (GB) ..... 1809182

(51) Int. Cl.
*E05F 1/08* (2006.01)
*E05F 5/00* (2017.01)
*E05F 3/20* (2006.01)

(52) U.S. Cl.
CPC ..... *E05F 5/006* (2013.01); *E05F 3/20* (2013.01); *E05Y 2201/484* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 9,163,447 B1 * 10/2015 Liang ..... E05F 3/20
9,328,544 B1 * 5/2016 Liang ..... E05F 3/20
(Continued)

FOREIGN PATENT DOCUMENTS

CN 103291164 A * 9/2013
CN 102434052 B 6/2014
(Continued)

OTHER PUBLICATIONS

International Search Report issued in corresponding International application No. PCT/EP2019/064147 dated Aug. 20, 2019 (3 pages).
(Continued)

*Primary Examiner* — Chuck Y Mah
(74) *Attorney, Agent, or Firm* — Ferguson Braswell Fraser Kubasta PC

(57) ABSTRACT

A hinge is provided with two elements pivotally connected together for relative rotational movement about a hinge axis. The hinge has a spring formed of bent wire. The spring is mounted on one of the elements and a mechanism causes it to apply a biassing force between the two elements over at least part of their relative rotational movement. The biassing force is transmitted via a finger on the spring. A spreader is arranged to fit over the finger for engagement with the other element. The spreader extends continuously over the finger and engages substantially the whole of the finger.

5 Claims, 1 Drawing Sheet

(52) U.S. Cl.
CPC ..... *E05Y 2600/53* (2013.01); *E05Y 2600/626* (2013.01); *E05Y 2900/20* (2013.01)

(58) Field of Classification Search
CPC ..... E05Y 2201/21; E05Y 2201/484; E05Y 2600/53; E05Y 2600/626; E05F 5/006; E05F 5/02; E05F 5/08; E05F 3/20; E05D 11/1021; E05D 11/1042; E05D 11/105; E05D 11/1064; E05D 7/04; E05D 7/0407; E05D 7/125; E05D 3/142
See application file for complete search history.

(56) References Cited

U.S. PATENT DOCUMENTS 9,366,067 B2 * 6/2016 Wu ..... E05F 5/006
10,030,427 B2 * 7/2018 McGregor ..... E05D 7/0415
10,494,850 B2 * 12/2019 Liang ..... E05F 3/20
2013/0167323 A1 * 7/2013 Bru ..... E05D 11/1014 16/50
2015/0240543 A1 * 8/2015 Ng ..... E05D 7/0407 16/233
2016/0138319 A1 * 5/2016 Wu ..... E05D 7/0415 16/50
2017/0254128 A1 * 9/2017 Ng ..... E05F 3/20

FOREIGN PATENT DOCUMENTS

CN 102889033 B 11/2015
CN 102953614 B 11/2015

OTHER PUBLICATIONS

Written Opinion of the International Searching Authority issued in corresponding application No. PCT/EP201/064147 dated Aug. 20, 2019 (5 pages).

* cited by examiner

HINGES

BACKGROUND

Hinges may include toggle-type hinges as used for kitchen cupboards and other applications.

SUMMARY

The invention provides a hinge having two elements pivotally connected together for relative rotational movement about a hinge axis, a spring formed of bent wire, and a mechanism for activating the spring to cause it to apply a spring biassing force between the two elements over at least part of their relative rotational movement, the spring being mounted on one of the elements and having a spring finger for transmitting said spring biassing force, with said mechanism including a spreader fitting over the spring finger and being in operative engagement with the other element, with the spreader being arranged to extend continuously over and engage substantially the whole of the finger.

By way of example, embodiments of the invention will now be described with reference to the accompanying drawings, in which:

DETAILED DESCRIPTION

Figure 1:
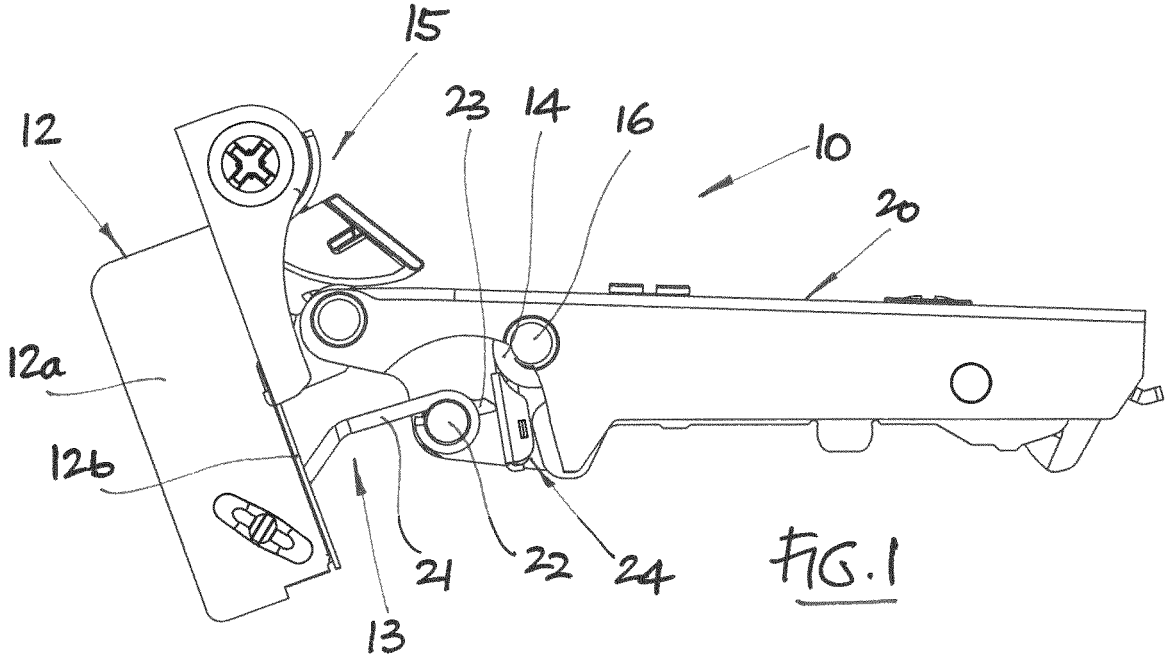
FIG. 1 illustrates a form of hinge according to embodiments of the invention.

Specific embodiments of the disclosed technology will now be described in detail with reference to the accompanying figures. Like elements in the various figures may be denoted by like reference numerals and/or like names for consistency.

The following detailed description is merely exemplary in nature, and is not intended to limit the disclosed technology or the application and uses of the disclosed technology. Furthermore, there is no intention to be bound by any expressed or implied theory presented in the preceding technical field, background, brief summary or the following detailed description.

In the following detailed description of embodiments of the disclosed technology, numerous specific details are set forth in order to provide a more thorough understanding of the disclosed technology. However, it will be apparent to one of ordinary skill in the art that the disclosed technology may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

FIG. 1 shows a hinge 10 of the kind conventionally known as a toggle-type hinge, typically used for hanging doors on kitchen cupboards. The hinge 10 is attachable to a cupboard carcase via an adjustable bracket 20, and is attachable to a door via a cupped flange 12, with a cup 12*a* to fit in a blind hole on the inner surface of the door, and a flange 12*b* to be fastened to the inner surface. The bracket 20 and cupped flange 12 are articulatedly connected together via a composite link mechanism 13 to enable relative pivotal movement of these elements about a hinge axis.

A return spring 14 is arranged to exert a force on the link mechanism 13 to assist the closing movement of the hinge 10 in known manner. In this example, the hinge 10 also incorporates a damping mechanism 15 arranged to provide damped resistance to the closing movement of the hinge 10, again in known manner.

Figure 2:
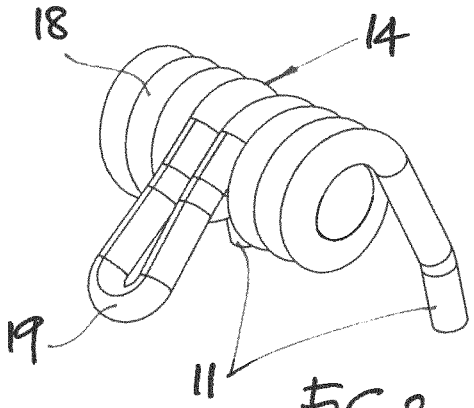
FIG. 2 is a detail showing the return spring of the hinge seen in FIG. 1 according to embodiments of the invention.

As seen in FIG. 2, the spring 14 is of a bent wire construction, formed with a series of helical coils 18 extending along an axis, with a middle part bent double to form an outwardly extending finger 19, and legs 11 extending outwardly at either end. The spring 14 is mounted on the bracket 20 via a pin 16 located axially within its coils 18.

One of the components of the composite link mechanism 13 is an arm 21 that is pivotally connected to the bracket 20 via a pin 22. The arm 21 is designed to include a protruding nose section 23, which is arranged to engage with the finger 19 of the spring 14. With the legs 11 of the spring 14 braced against the bracket 20, rotational movement of the hinge 10 will cause flexure of the finger 19 via its engagement by the nose section 23. The spring 14 is thus able to impart a spring biassing force to rotational movement of the hinge 10.

The geometry of the arrangement is chosen such that the nose section 23 will go "over centre" in its engagement with the finger 19, in known manner. Thus, for a first range of rotational movement of the hinge 10, the biassing force exerted by the spring 14 will be in opposition to it, whereas for a second range of the hinge rotation, the spring force will be such as to assist it. The hinge 10 is thus effectively bi-stable, ie it has two possible "at rest" positions, corresponding to the open and closed positions of the door that it mounts. Here, the spring 14 is arranged to assist the hinge 10 in the closing movement of the door that it mounts, against the damped resistance of the damping device 15.

Figure 4:
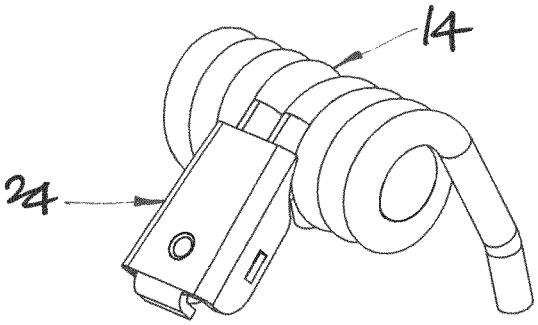
FIG. 4 is a detail showing the spreader in position on the return spring according to embodiments of the invention.

The nose section 23 of the arm 21 is designed to be in constant engagement with the finger 19 of the spring 14. A consequence of this is that it will give rise to frictional forces in operation of the hinge 10 that will tend to cause wear to the nose section 23 and/or finger 19. This could be compensated for to some extent by treating these components, for example by case hardening. However, a better solution is to provide the spring 14 with a spreader 24, as seen in FIG. 4.

Figure 3:
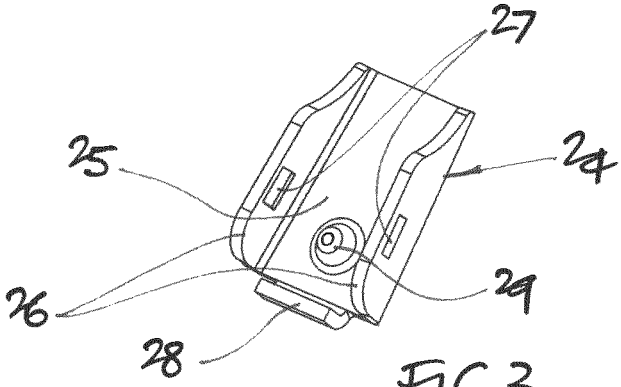
FIG. 3 is a detail showing the spreader for the return spring according to embodiments of the invention.

As seen in FIG. 3, the spreader 24 is of a channel-like construction with a central planar plate 25 of rectangular shape having upstanding sidewalls 26 extending along its longitudinal edges. The spreader 24 is designed to fit over the finger 19, as seen in FIG. 4, with the sidewalls 26 straddling it to either side. Each of the sidewalls 26 is provided with a protruding lug 27 on its inner surface to hold the spreader 24 in position after it has been sprung onto the finger 19. A flange 28 at the end of the spreader 24 and a protruding boss 29 in its central plate 25 further help to locate and retain it in position on the finger 19.

It will be noted that the spreader 24 is designed to engage the finger 19 over substantially the whole of its length. This has the advantage of spreading the load on the finger 19 from its engagement with the nose section 23 as much as possible. This makes for a stronger arrangement than if the finger 19 were to be engaged over only part of its length.

Another advantage of the spreader design here is in its manner of engagement with the nose section 23, which will be essentially in the form of line contact. This is an improvement over conventional hinge mechanisms, where the straight edge of the nose section makes contact with the round wire of the spring finger at two discrete points. The addition of the spreader 24 will thus help to increase the life expectancy of the hinge 10 by a considerable margin.

A further advantage of the spreader design here is that it can be incorporated into the hinge manufacturing process with only a minimal amount of adaptation from a standard production line.

While the disclosed technology has been described with respect to a limited number of embodiments, those skilled in the art, having benefit of this disclosed technology, will appreciate that other embodiments can be devised which do not depart from the scope of the disclosed technology as disclosed herein. Accordingly, the scope of the disclosed technology should be limited only by the attached claims.

The invention claimed is:

1. A hinge comprising:

a first hinge element and a second hinge element pivotally connected together for relative rotational movement about a hinge axis, a spring formed of bent wire, and a mechanism for activating the spring to cause it to apply a spring biassing force between the first hinge element and the second hinge element over at least part of their relative rotational movement, the spring being mounted on the first hinge element and having a spring finger for transmitting said spring biassing force, with said mechanism including a spreader fitting over the spring finger and being in operative engagement with the second hinge element, with the spreader being arranged to extend continuously over and engage substantially the whole of the length of the spring finger, wherein the spreader is of a channel-shaped construction and is arranged to straddle the spring finger.

2. A hinge as claimed in claim 1 wherein the spreader is designed to fit over the spring finger by means of a snap fit.

3. A hinge as claimed in claim 1 wherein the spreader is formed with lugs to retain it in position on the spring finger.

4. A hinge as claimed in claim 1 wherein the spreader is substantially planar where it operatively engages the second hinge element.

5. A hinge as claimed in claim 1 wherein the operative engagement of the spreader with the second hinge element is in the form of line contact.

* * * * *